United States Patent [19]

Steinnagel

[11] Patent Number: 4,974,729

[45] Date of Patent: Dec. 4, 1990

[54] REMINDER SYSTEM FOR TAKING MEDICATION

[75] Inventor: Kent P. Steinnagel, Larchmont, N.Y.

[73] Assignee: Bristol-Myers Squibb Company, New York, N.Y.

[21] Appl. No.: 342,765

[22] Filed: Apr. 17, 1989

[51] Int. Cl.[5] ..... B65D 83/04

[52] U.S. Cl. ..... 206/531; 206/532; 206/534; 206/534.1; 206/820

[58] Field of Search ..... 206/534, 531, 532, 459, 206/820, 529, 530, 534.1, 534.2; 116/306, 308, 324

[56] References Cited

U.S. PATENT DOCUMENTS

| | | | |
|---|---|---|---|
| D. 210,847 | 4/1968 | Aron . | |
| D. 212,872 | 12/1968 | MacLachlan et al. . | |
| D. 215,649 | 10/1969 | MacLachlan et al. . | |
| 3,305,077 | 2/1967 | Greif et al. . | |
| 3,324,995 | 6/1967 | Sharp, Jr. | 206/534 |
| 3,397,671 | 8/1968 | Hartman, Jr. et al. | 206/534 |
| 3,432,951 | 3/1969 | Cherrin . | |
| 3,494,322 | 2/1970 | Dubbels . | |
| 3,743,084 | 7/1973 | Douglas | 206/532 |
| 4,254,871 | 3/1981 | Poore . | |
| 4,295,567 | 10/1981 | Knudsen . | |
| 4,340,141 | 7/1982 | Fischer | 206/534 |
| 4,534,468 | 8/1985 | Nuckols et al. . | |

FOREIGN PATENT DOCUMENTS

| | | |
|---|---|---|
| 28379 | 2/1987 | Japan . |
| 224352 | 10/1987 | Japan . |

*Primary Examiner*—Paul T. Sewell
*Assistant Examiner*—Jacob K. Ackun, Jr.
*Attorney, Agent, or Firm*—Gene Warzecha

[57] ABSTRACT

A calendar type dispenser is provided in association with a separable indicia means, the combination comprising a reminder system for reminding users when a particular dosage of medicament must be taken. The medicament container comprises a blister pack dispenser wherein a plurality of blisters are linearly arranged, in one or more groups, each group having a predetermined number of blisters. Each group has associated therewith a means for retaining a separable overlying planar sheet member provided with a plurality of apertures corresponding to the number of blisters in a selected group. Suitable indicia are marked on the sheet member in associating with each aperture thereof thereby identifying the particular dosage in each blister with the time when it should be taken.

2 Claims, 3 Drawing Sheets

REMINDER SYSTEM FOR TAKING MEDICATION

BACKGROUND OF THE INVENTION

1. Field of the Invention

The invention relates to time reminder or indicator devices associated with medicament containers for indicating when a dose of medicine should be taken. In particular, the invention relates to a time reminder system for use with blister-pack containers of discrete quantities of medicine.

2. Description of the Prior Art

There are numerous prior art examples of medicament containers provided with time reminder or calendar devices. Generally, the containers have, affixed to them, reminder devices which bear a plurality of indicia corresponding to desired time periods: for example, the indicia may correspond to hours, days of the week, etc. In the case of bottle-type containers, the time indicia are generally affixed to a member which is slidably or rotatably movable relative to a fixed index mark on the container, or vice-versa. In certain embodiments, however, the medicament container may take the form of a blister-pack pill dispenser having individually openable pill pockets and the indicia in such cases may be nothing more than printed information adjacent each blister associating each discrete dose (i.e. blister contents) with a day of the week, for example, indicating that the medication dosage in that blister is required to be taken at the indicated time. This type of time reminder device is commonly used in containers of birth control pills and one such device is known for dispensing aspirin tablets, each blister being marked with a day of the week. In any event, the indicia used on such dispensers are an integral part of the dispensers and, if for some reason a different time schedule is desired, the dispenser is unusable for such different schedule and a whole new dispenser/indicia package must be prepared for each new schedule.

In some instances, medications must be prescribed by licensed physicians so that the proper dosages may be taken by the patient at uncommon although prescribed intervals (not simply daily) under proper supervision. In such instances, calendar type dispensing devices are helpful to the consumer. It has been found, however, that such prior art dispensing devices are either not available with respect to certain medications because of regulatory prohibitions or are not easily alterable to vary the dispensing time schedule in response to certain conditions which may require a different regimen.

For certain medicaments which are available over-the-counter (OTC) for general use, but which must be prescribed by a physician in a certain regimen for some indications, the inability to purchase the medicament OTC with a reminder device is an inconvenience. For example, aspirin is available OTC and is used for a variety of purposes. It has recently been determined as a result of some test studies that certain regimens of aspirin may be helpful for certain medical indications. For example, certain dosages of aspirin taken periodically were shown to be helpful in reducing the incidence of secondary myocardial infarction (MI). The clinical data has, to date, apparently been insufficient to obtain governmental regulatory approval to enable aspirin manufacturers to market analgesic products for an indication of secondary MI directly to the public without professional supervision. That is, for example, it is not yet permissible to sell an aspirin product directly to the public in a container provided with a time reminder system suggesting that specific doses be taken at prescribed times in order to decrease the likelihood of a secondary MI.

Nevertheless, it is permissible for physicians to prescribe specific aspirin regimens to certain patients and it would, therefore, be desirable to provide appropriate calendar type aspirin dispensers to be used by physicians. However, once a prior art calendar dispenser is given to a patient, because the indicia are an integral part of the dispenser, it is usable for only a limited time until the medication runs out. At that time, the patient must return to the physician or renew the prescription to obtain another calendar type dispenser. This may not only be an inconvenience to the physician and the patient, but it may also be unnecessary if the physician can more easily direct how the patient should continue taking medication. Some mechanism is desirable to enable physicians to treat selected patients easily and conveniently.

It would be desirable to provide the physician with a time reminder device which could be prescribed for particular patients and applied to containers or dispensers generally available OTC. Thus, for example, a calendar type blister-pack container could be initially dispensed by the physician together with a separable time reminder device indicating a predetermined dosage schedule. When the medicine is all used up, the consumer could transfer the separable time reminder device to another medicament container which could be purchased OTC. Thus, a particular patient would be able to obtain an initial prescription from a physician and, subsequently, purchase medicine containers over-the-counter without the inconvenience of returning to the physician or a pharmacy merely to pick up medicine which is available OTC.

In many instances, medication is prescribed on a varying schedule in order for the patient to be slowly introduced to or withdrawn from an efficacious medicament level. For example, beta blockers, anticonvulsants and antidepressants must generally be prescribed in stages. In situations where a physician may desire to provide a patient with a time reminder device in association with medication which must be introduced or withdrawn in stages, it would be desirable to provide the physician with a variety of time reminder devices usable with a common container such that the regimen for taking the medication would be easily variable in order to reflect the elements of dosage quantity and frequency of the various desirable stages.

In view of the above, it is an object of this invention to provide a time reminder system having an indicia means separable from a medicament dispenser.

It is a further object to provide a time reminder system which enables a blister-pack medicament dispenser to be usable either with or without any time reminder indicia.

It is yet another object of this invention to provide a time reminder system which enables a physician to prescribe for selected patients a medicament regimen which may be monitored by the physician as well as conveniently refilled by the patient by OTC purchases of medicament.

An additional object of this invention is to provide a reminder system for a blister-pack medicament dispenser wherein the time schedule of the system is easily variable.

SUMMARY OF THE INVENTION

These and other objects of the invention are achieved by the preferred embodiment disclosed herein in the form of a reminder system for providing an indication of when a dose of medication should be taken, comprising: a planar medication holder for holding a plurality of unit doses of medication, said holder having a front surface and a rear surface; frangible means retaining said unit doses of medication to said holder; a planar indicia means adapted to be retained adjacent said front surface of said holder, said indicia means provided with a plurality of visible indicia each of which is associated with one of said unit doses when said indicia means is attached to said holder; means for separably retaining said indicia means to said holder.

DESCRIPTION OF THE PREFERRED EMBODIMENT

Figure 1:
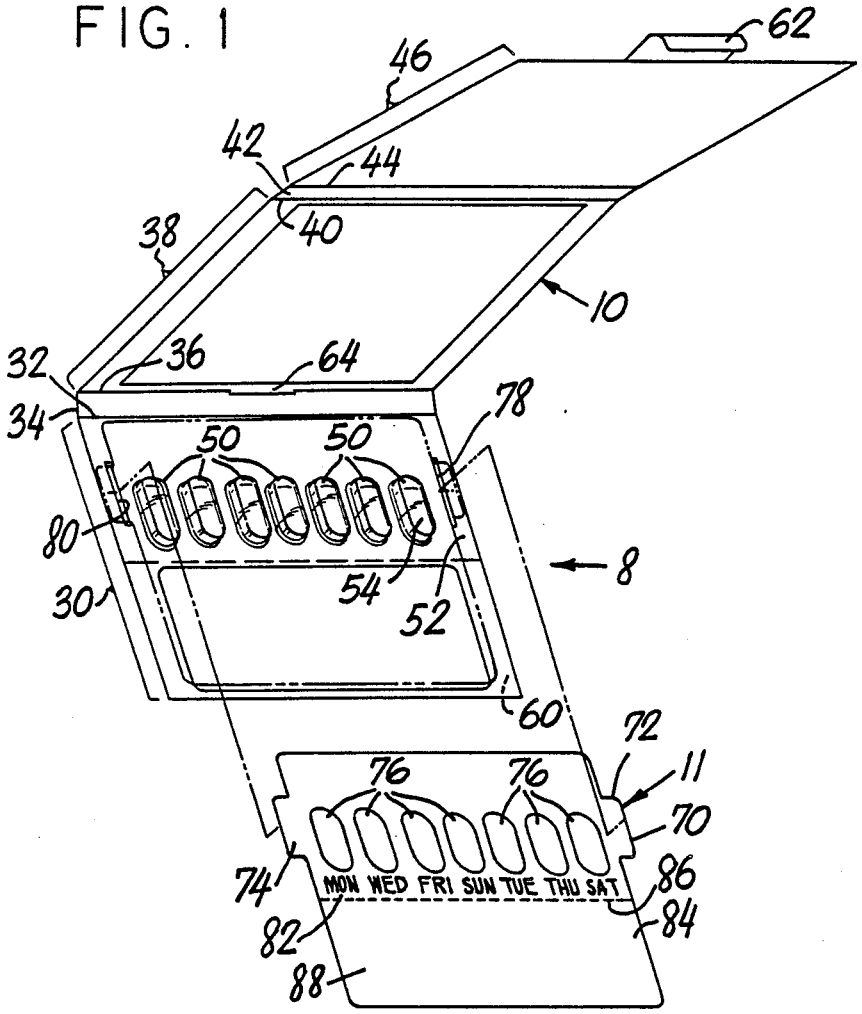
FIG. 1 is a front perspective view of a foldable, medicament containing blister package embodying the principles of the invention.

Referring to FIG. 1, there is shown a front perspective view of a preferred embodiment of a reminder system 8 constructed in accordance with the principles of this invention and comprising foldable blister pack dispenser 10 and separable indicia means 11.

Figure 2:
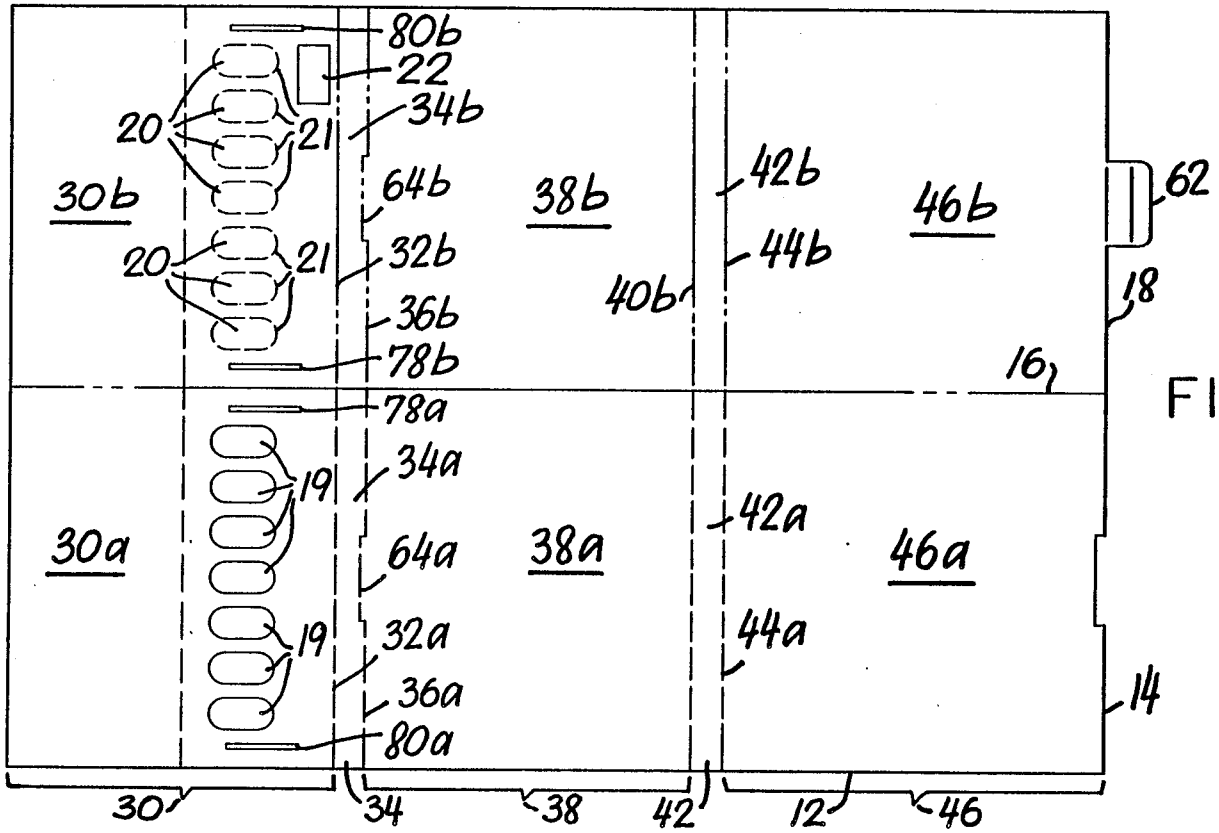
FIG. 2 is a plan view of paperboard blank used in the manufacture of the foldable blister package of FIG. 1.

Dispenser 10 is constructed in a conventional manner from a paperboard blank 12 (best seen in FIG. 2). Blank 12 comprises a top panel 14 foldable along fold line 16 in order to be placed in abutting relationship over bottom panel 18. Panel 14 is provided with a plurality of linearly arranged apertures 19 and panel 18 is provided with a corresponding plurality of filled areas 20 each circumscribed by a score line 21 (to facilitate opening the blister, as will be understood below). Each panel is also provided with a plurality of fold lines separating the panels into various portions described below. It will be understood by those skilled in the art that a suitable thermo-formed blister containing material (not shown) will be sandwiched between the folded panels 14 and 18 such that the blisters 50 (best seen in FIG. 1) will protrude through apertures 19. A suitable frangible foil backing (not shown) is sealingly secured to the rear surface of the blister material adjacent bottom panel 18 in order to retain a desired medicament in tablet or other form placed within each of the blisters.

As best seen in FIG. 1, dispenser 10 comprises a medicament or tablet containing portion 30 joined along a fold line 32 to a broad hinge portion 34 which is in turn joined along fold line 36 to cover portion 38. The latter is joined along fold line 40 to a broad hinge portion 42 which is in turn joined along fold line 44 to a locking flap portion 46. Some various other parts of dispenser 10 are numbered with an "a" and "b" suffix to the numbers used in FIGS. 1 and 2 indicating that some features of the final, folded dispenser are formed of two cooperating ("a" and "b") parts of both panels. Aperture 22 is provided to view a date code on the foil backing (not shown).

Tablet containing portion 30 comprises a plurality of blisters 50, each extending above the top surface 52 of portion 30 and each containing a medicament dosage 54 in tablet or other form. The purpose of the broad hinge portions 34 and 42 is to assure that, when cover portion 38 is folded adjacent and parallel to portion 30, it remains spaced sufficiently therefrom to avoid crushing the blisters. It should be apparent to those skilled in the art that the various portions 30, 38 and 46 are foldable into a compact package with locking flap 46 ultimately lying parallel to the back surface 60 of portion 30 such that locking tab 62 may be inserted into cooperating locking slit aperture 64 in order to keep dispenser 10 in a closed position.

Indicia means 11 comprises a separable sheet member 70 which in the preferred embodiment is formed from a relatively firm, durable and reusable material (such as any suitable plastic or thick gauge paperboard) and is provided with locking tabs 72 and 74 and a plurality of apertures 76. Locking tabs 72 and 74 are intended to cooperate with locking slits 78 and 80, respectively, in order to retain sheet member 70 adjacent the top surface 52 of portion 30 in a manner such that blisters 50 extend through apertures 76. Sheet member 70 must be bent slightly in order to engage tabs 72 and 74 with their respective slits. Any suitable indicia 82 may be printed on the top, visible surface of sheet member 70, thus identifying which tablet should be taken at which time in accordance with a regimen prescribed by a physician. A differing schedule could be printed on the reverse side of sheet member 70 (not shown) in order to give the physician some flexibility to easily alter the regimen for a particular patient. Obviously, other sheet members could be prepared to define any other desired schedules.

Sheet member 70 may be initially formed with an attached flap 84 joined to the sheet member along a perforated line 86 so that it may be detached when desired. Flap 84 may include any desirable identifying instructional or advertising printed information 88. Similar information may obviously be included on the various portions 30, 38 and 46.

Figure 3:
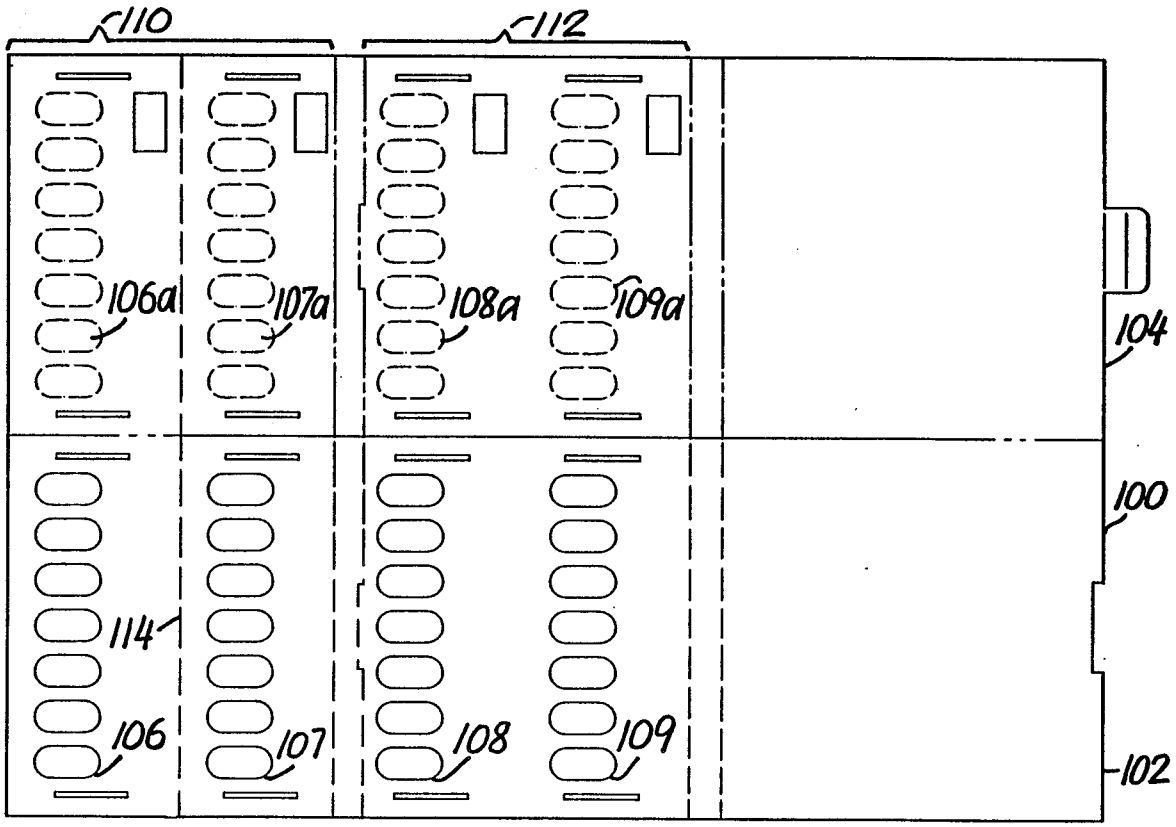
FIG. 3 is a plan view of an alternate embodiment of a paperboard blank usable to produce a larger foldable blister package of the type shown in FIG. 1.

It will be understood that blister pack 10 may be formed in any desired size with any number of blisters. The preferred embodiment shown in FIG. 2 is, along with the sheet member shown, convenient for a weekly supply of medicament dosages to be taken on alternate days. FIG. 3 shows a plan view of a paperboard blank 100 which could be used in a conventional manner to produce a 28 tablet dispenser. It will be understood that the panels 102 and 104 are folded and cooperate in a manner identical to the cooperation between panels 14 and 18 of FIG. 2. The groups 106, 107, 108 and 109 of linearly arranged apertures and their counterpart filled/scored areas **106*a*, 107*a*, 108*a* and 109*a* are staggered so that when the panel 110 carrying apertures 106 and 107 is folded over adjacent to panel 112 carrying apertures 108 and 109, the groups 106 and 107 are arranged in interdigitated fashion adjacent groups 108 and 109. Panel 110 may be provided with a perforation 114 to enable the strip containing group 106 to be torn away when the tablets in that group are used up. Sheet member 70** could be used with such a dispenser merely by moving it from one row of blisters to the next as necessary.

It will be understood by those skilled in the art that numerous improvements and modifications may be made to the preferred embodiment of the invention disclosed herein without departing from the spirit and scope thereof.

What is claimed is:

1. A reminder system for providing an indication of when a dose of medication should be taken, comprising:

a planar medication holder for holding a plurality of unit doses of medication, said holder having a front surface and a rear surface;

frangible means retaining said unit doses of medication to said holder;

a planar indicia means adapted to be retained adjacent said front surface of said holder, said indicia means comprising a planar sheet member provided with a plurality of apertures adapted to overlay said holder so that said unit doses of medication retained thereby are accessible through said apertures, said plurality of apertures being at least equal in number and identical in spatial orientation to said unit doses of medication, said indicia means provided with a plurality of visible indicia each of which is associated with one of said unit doses when said indicia means is attached to said holder;

means for separably retaining said indicia means adjacent said holder, said means comprising a pair of tabs extending away from each other at opposing sides of said planar sheet member and retaining means associated with each planar medication holder for receiving said pair of tabs and retaining same.

2. A reminder system for providing an indication of when a dose of medication should be taken, comprising:

a plurality of planar medication holders each for holding a plurality of unit doses of medication, said planar medication holders being removably attached to each other;

frangible means retaining said unit doses of medication to said holders;

at least one indicia means, a separate indicia means removably attachable to a selected one of said planar medication holders and comprising a planar sheet member adapted to be retained adjacent said selected planar medication holder, said planar sheet member provided with a plurality of apertures adapted to overlay said selected planar medication holder so that said unit doses of medication retained thereby are accessible through said apertures, said plurality of apertures being at least equal in number and identical in spatial orientation to said unit doses of medication, said indicia means provided with a plurality of visible indicia each of which is in proximity to an associated one of said unit doses when said indicia means is attached to said selected one of said holders;

means for separably retaining a selected one of said indicia means adjacent any one of said planar medication holders, said means comprising a pair of tabs extending away from each other at opposing sides of said planar sheet member and retaining means associated with each planar medication holder for receiving said pair of tabs and retaining same.

* * * * *